US009285081B2

(12) United States Patent
Douglas et al.

(10) Patent No.: US 9,285,081 B2
(45) Date of Patent: Mar. 15, 2016

(54) LED HIGH BAY LIGHTING SOURCE

(71) Applicants: David Douglas, Oak Park, MI (US); Thomas E. Stack, Oxford, MI (US)

(72) Inventors: David Douglas, Oak Park, MI (US); Thomas E. Stack, Oxford, MI (US)

(73) Assignee: Q Technology, Inc., Livermore, CA (US)

( * ) Notice: Subject to any disclaimer, the term of this patent is extended or adjusted under 35 U.S.C. 154(b) by 0 days.

(21) Appl. No.: 13/916,573

(22) Filed: Jun. 12, 2013

(65) Prior Publication Data

US 2014/0085883 A1 Mar. 27, 2014

Related U.S. Application Data

(60) Provisional application No. 61/659,398, filed on Jun. 13, 2012.

(51) Int. Cl.

| | |
|---|---|
| ***F21K 99/00*** | (2010.01) |
| ***F21V 7/05*** | (2006.01) |
| ***F21V 7/04*** | (2006.01) |
| ***F21V 29/77*** | (2015.01) |
| *F21V 29/02* | (2006.01) |
| *F21V 3/00* | (2015.01) |
| *F21S 8/02* | (2006.01) |
| *F21Y 101/02* | (2006.01) |
| *F21V 29/505* | (2015.01) |
| *F21V 29/507* | (2015.01) |

(52) U.S. Cl.

CPC . *F21K 9/13* (2013.01); *F21V 7/043* (2013.01); *F21V 7/05* (2013.01); *F21V 29/77* (2015.01); *F21K 9/00* (2013.01); *F21S 8/02* (2013.01); *F21V 3/00* (2013.01); *F21V 29/02* (2013.01); *F21V 29/505* (2015.01); *F21V 29/507* (2015.01); *F21Y 2101/02* (2013.01)

(58) Field of Classification Search

CPC ..... F21V 29/2225; F21K 9/13
USPC ..... 362/235, 249.02, 294, 373
See application file for complete search history.

(56) References Cited

U.S. PATENT DOCUMENTS

| | | | | |
|---|---|---|---|---|
| 7,905,634 | B2 * | 3/2011 | Agurok et al. | 362/296.01 |
| 8,342,710 | B2 * | 1/2013 | Rahbar-Dehghan | 362/249.02 |
| 8,393,757 | B2 * | 3/2013 | Uemoto et al. | 362/249.03 |
| 8,434,899 | B2 * | 5/2013 | Lee et al. | 362/249.02 |
| 8,764,247 | B2 * | 7/2014 | Pattekar et al. | 362/294 |
| 2009/0027889 | A1 * | 1/2009 | Kang et al. | 362/294 |
| 2009/0046464 | A1 * | 2/2009 | Liu et al. | 362/294 |
| 2011/0222307 | A1 * | 9/2011 | Kong | 362/554 |
| 2011/0267812 | A1 * | 11/2011 | Van De Ven et al. | 362/235 |
| 2012/0092870 | A1 * | 4/2012 | Tralli et al. | 362/249.02 |
| 2014/0126213 | A1 * | 5/2014 | Pattekar et al. | 362/294 |

* cited by examiner

*Primary Examiner* — Anabel Ton
(74) *Attorney, Agent, or Firm* — Theodore C. Huff

(57) ABSTRACT

A lighting device includes a housing having an inner surface and outer surface and a plurality of LEDs mounted at the inner surface, the LEDs mounted in a radially symmetrical configuration. The inner surface may be made of or coated with reflective material. The lighting system may further include, individually or in any combination, following: heat sink fins mounted on the outer surface; a reflective plate for reflecting light in a desired direction; a reflective tube for redirecting light from the LEDs. The housing may include a cylindrical section and a conic section.

3 Claims, 10 Drawing Sheets

| ITEM NO. | PART NUMBER | NAME |
|---|---|---|
| 1 | HB-001 | MAIN PLATE |
| 2 | HB-002 | FAN |
| 3 | HB-003 | POWER BOARD |
| 4 | HB-004 | WIRE EGRESS BRACKET |
| 5 | HB-005 | COVER BOX |
| 6 | HB-006-B | STRUT FOR NARROW DISH |
| 7 | HB-007-B | NARROW DISH |
| 8 | HB-008 | GLASS |
| | HB-009 | INNER RING |
| | HB-010 | OUTER RING |
| 12 | HB-011-C1 | PENDANT V SHAPE |
| 13 | HB-011-C2 | PENDANT V SHAPE DOOR |
| | HB-C-001 | MACHINE SCREW |
| | HB-C-002 | EXTERNAL TOOTH LOCK WASHER |
| | HB-C-003 | NUT |
| | HB-C-004 | STAND OFF FOR PCB |
| | HB-C-005 | RUBBER GROMMET |
| | HB-C-006-A | STANDARD RIVETS |
| | HB-C-006-B | RIVETS FOR STRUTS |
| | HB-C-007 | STRAIN RELIEF BUSHINGS |
| | HB-C-008 | SHEET METAL SCREW |
| | HB-C-009-B | STEEL NIPPLE |
| | HB-C-010 | LOCK WASHER SLIPS |
| | HB-C-011 | ZINC LOCKNUT |
| | HB-C-012 | REGULAR WASHER |
| | HB-C-013 | FLAT HEAD SCREW |
| | HB-C-014 | LENS GROMMET |
| 29 | HB-E-001 | SQUARE LED 16x16mm |
| 10 | HB-E-002 | SVT CORD FOR V PENDANT |

Fig. 13b

LED HIGH BAY LIGHTING SOURCE

REFERENCE TO RELATED APPLICATIONS

This patent application claims the benefit of priority under 35 USC sections 119 and 120 of a provisional patent application filed Jun. 13, 2012 having Application Ser. No. 61/659,398. The entirety of the said U.S. provisional application 61/659,398, entitled "LED High Bay Lighting Source", is incorporated by reference herein.

BACKGROUND

This invention relates to lighting systems, in particular lighting systems for illuminating extended areas, such as at a warehouse, walk-in cooler, or retail area.

In earlier decades, fluorescent and incandescent lights were used to provide electric powered illumination. As is well known, LED (Light Emitting Diode) technology provides more energy efficient light output compared to the light output efficiency of the prior technologies. However, an LED chip's lighting geometry differs from that of the previous lighting sources. The LED chip's lighting emission surface tends to have essentially planar emission surface of an incandescent bulb or tubular emission surface as with some fluorescent sources.

Therefore, though LED technology is more efficient, the characteristically flat LED sources may not be desirable for some applications, for example, with existing lighting fixtures using bulb-shaped sources. Despite having different light source emission geometry, there is a need in the art for LED lighting configurations that produce substantially the same lighting patterns as prior lamp technology lighting systems.

SUMMARY

One object of the present invention is to provide a sufficiently bright and radially uniform lighting pattern in spite of the substantially planar LED surface shape, and despite gaps between LEDs. Another object of the invention is to accommodate properly conditioned electrical supply to and heat removal from the LEDs. Still other objects of the present invention are that in addition to being an energy efficient lighting source, this lighting system is intended to be easy to assemble and robust.

In one embodiment of the present invention, a lighting device includes a housing having an inner surface and outer surface and a plurality of LEDs mounted at the inner surface, the LEDs mounted in a radially symmetrical configuration. The inner surface may be made of or coated with reflective material.

The lighting system may further include heat sink fins mounted on the outer surface of said housing, each heat sink fin mounted proximal to a corresponding LED but at the opposite surface of the housing. The lighting system may further include a reflective plate mounted within the housing for reflecting light from the LEDs in a desired direction. The lighting system may further include a reflective tube disposed coaxially within the housing for redirecting light from the LEDs.

The lighting system may further include a light transmissive plate attached to the housing by a retaining ring. The lighting system may further include a circuit board including electrical components connected to the LEDs, the components adapted to transform input electrical power for deliver to the LEDs.

In another embodiment of the present invention, a lighting device includes a housing including a cylindrical section and a conic section, the conic section having an inner surface and outer surface. A plurality of LEDs are mounted to the housing at the inner surface, the LEDs mounted in a radially symmetrical configuration. A plurality of heat sink fins mounted to the housing at the outer surface. Each heat sink fin is mounted proximal to a corresponding LED but at the opposite surface of the housing. A reflective plate is mounted within the housing for reflecting light from the LEDs in a desired direction. A reflective tube is disposed coaxially within the housing for redirecting light from the LEDs. An optional light transmissive plate is attached to the housing by a retaining ring.

Further aspects of the present invention will become apparent from the following detailed description when considered in conjunction with the accompanying drawings. It should be understood, however, that the detailed description and the specific examples while representing the preferred embodiments are given by way of illustration only.

BRIEF DESCRIPTION OF THE DRAWINGS

FIG. 13*b* shows a parts list for the elements called out numerically in FIG. 13*a*.

DETAILED DESCRIPTION

The present invention will now be described with reference to the FIGS. 1 through 8 which illustrate various aspects, embodiments, or implementations of the present invention. In the Figures, some sizes of structures, portions, or elements may be exaggerated relative to sizes of other structures, portions, or elements for illustrative purposes and, thus, are provided to aid in the illustration and the disclosure of the present invention. In this document, terms "above" and "below", "upper" and "lower" are intended only for convenience in referring to drawing orientation. In actual use, alternate lighting assembly orientations are possible.

While the present invention is capable of embodiment in many different forms, the drawings show preferred embodiments of the invention with the understanding that the present disclosure is to be considered as an exemplification of the principles of the invention and is not intended to limit the broad aspect of the invention to the embodiments illustrated.

Figure 1:
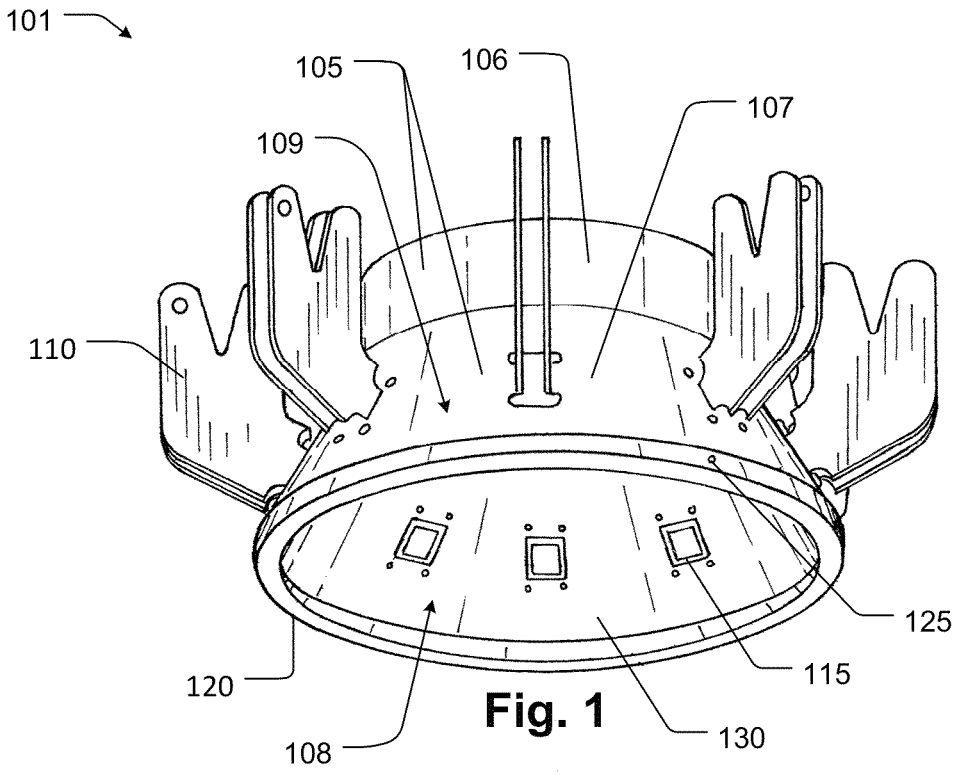
FIG. 1 is a perspective view of a lighting device in accordance with one embodiment of the present invention.
Figure 2:
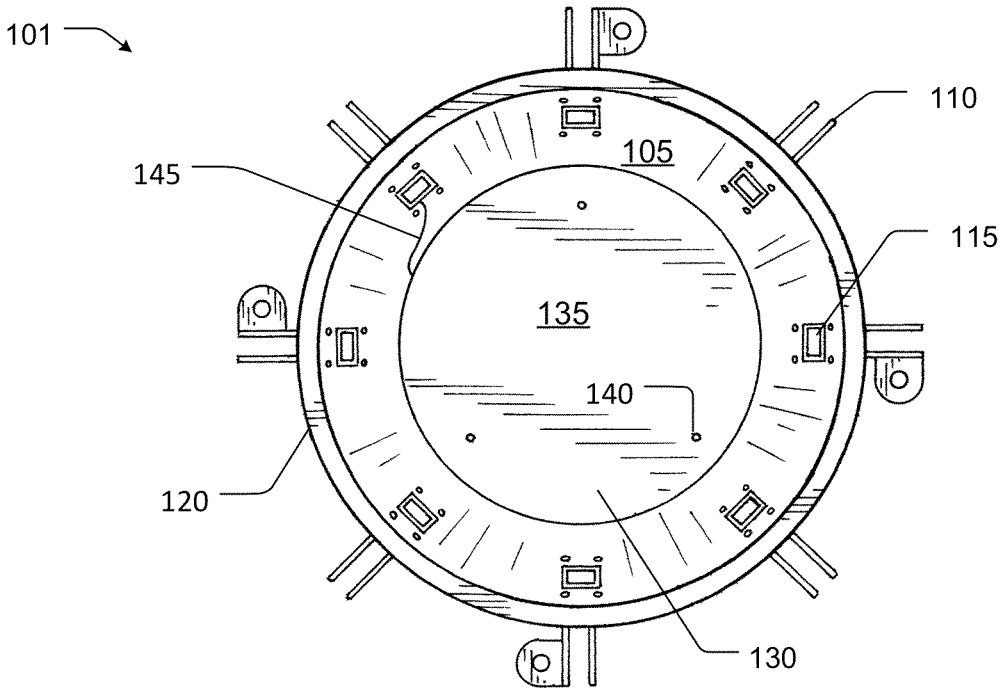
FIG. 2 is a bottom view of the lighting device of FIG. 1.
Figure 3:
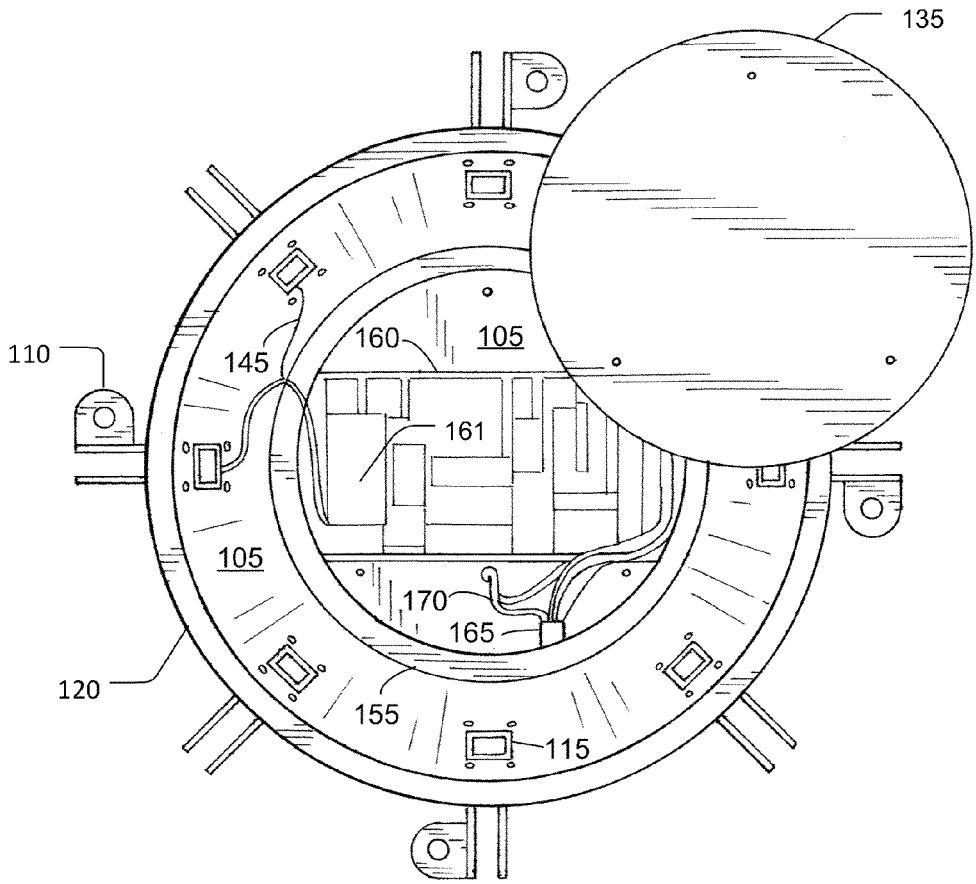
FIG. 3 is another bottom plan view of the lighting device of FIG. 1 showing additional elements.
Figure 4:
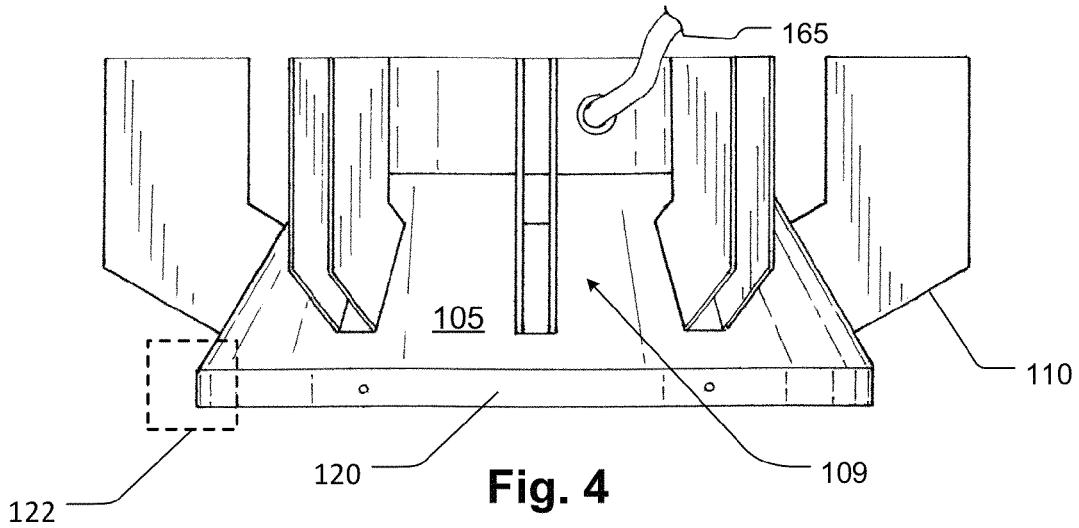
FIG. 4 is a side view of the lighting device of FIG. 1.
Figure 5:
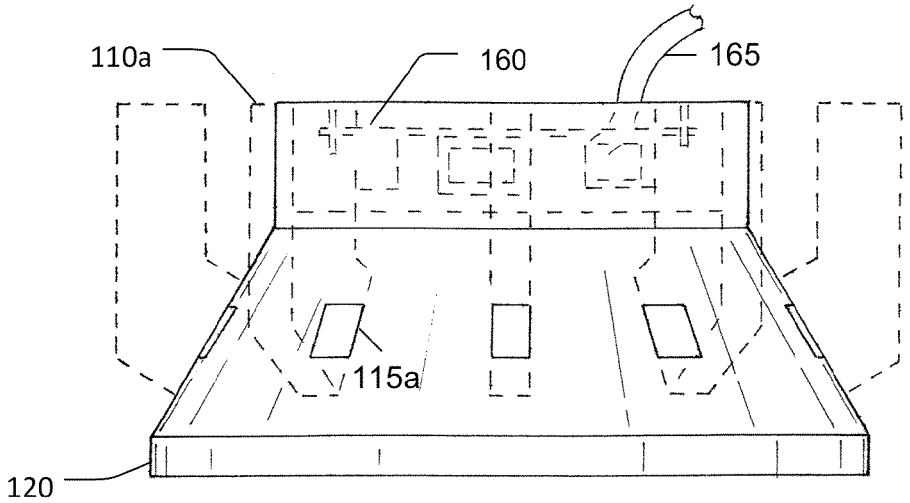
FIG. 5 is another side view of the lighting device of FIG. 1 but with hidden elements illustrated.
Figure 6:
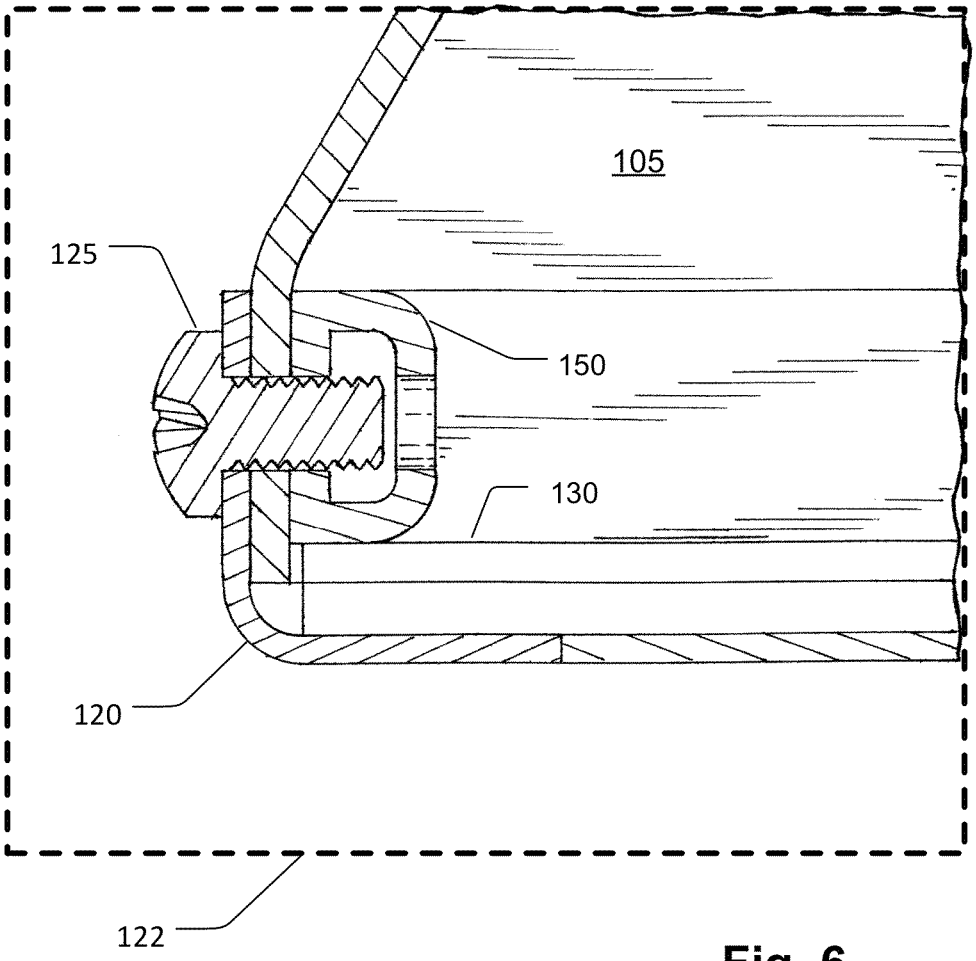
FIG. 6 is a cutaway side view of a portion of the lighting device of FIG. 1 illustrating the portion in more detail.

FIG. 1 shows a lighting device 101 in accordance one embodiment of the present invention. FIG. 2 is a bottom view of the lighting device 101 of FIG. 1. FIG. 3 is another bottom view of the lighting device of FIG. 1 showing additional elements. FIG. 4 is a side view of the lighting device of FIG. 1. FIG. 5 is another side view of the lighting device of FIG. 1 but with hidden elements illustrated. FIG. 6 is a cutaway side view of a portion of the lighting device of FIG. 1 illustrating portions in more detail.

Referring to FIGS. 1 through 6 inclusive, but mostly to FIG. 1, the lighting device 101 includes a housing 105, the housing 105 having two sections—a hollow cylindrical section 106 (herein after referred to as the "cylindrical section" 106) and a truncated hollow conic section 107 (hollow frustoconical section, herein after referred to as the "conic section" 107), the conic section 107 attached to the cylindrical section 106. The conic section 107 having an inner surface 108. The conic section 107 and the cylindrical section 106, together, are referred to as the housing 105.

The housing 105 is substantially hollow with open ends, serving as a support structure with openings for light to pass through. In the illustrated embodiment, the housing 105, as illustrated, is a truncated hollow cone attached to a hollow cylinder, but, in other embodiments, may be fashioned in other shapes, for example a bell, hemispherical or ellipsoidal shape, or sections thereof. Also, though the housing 105 is shown as a shape that could be made of sheet material for ease of construction, it should be understood that a hollow solid with the same or similar internal surface shape could also be used to provide a housing for the present invention. Alternatively, instead of the housing sides being angled or contoured to form a partial cone or bell shape, the underside of the housing 105 may be substantially flat, as a plate.

A plurality of LEDs 115 are mounted in or to the housing 105 at the inner surface 108 of the housing 105. The inner surface 108 of the housing 105 is preferably made of or coated with a reflective material thereby reflecting light generated by the LEDs 115. The LEDs 115 are illustrated as having rectangular shape, but it should be understood that LEDs of other shapes may be used, for example LEDs having round or polygonal geometric shapes. As illustrated, the LEDs 115 are mounted in a radially symmetrical configuration.

At one open end of the housing 105, a light transmissive plate 130 may be attached to the housing 105, providing protection for the LEDs 115 while allowing the light from the LEDs 115 to pass through. In FIG. 1, reference number 130 generally points to the light transmissive plate 130. The transmissive plate 130 provides a barrier against dust and moisture, thus protecting the LEDs 115. The light transmissive plate 130 may be clear, translucent, or frosted, for example, as long as it allows the light generated within the housing 105 to emerge from the device 101. A retaining ring 120 retains the light transmissive plate 130 in place. Fasteners 125 attach the retaining ring 120 to the housing 105.

Continuing to refer to FIGS. 1 through 6, but mostly to FIG. 2, LED wires 145 connect the LEDs 115 to, ultimately, an external power source (not illustrated). As shown, the LED wires 145 may be routed on the inner surface 108 of housing 105. Alternatively, the LED wires 145 may be placed within the housing 105 (e.g. via grooves or holes) to allow different wire routing if desired.

A reflective plate 135 may be placed within the housing 105 to reflect light from the LEDs 115 in a desired direction. Reflective plate fasteners 140 engage the reflective plate 135 to the housing 105.

FIG. 3 is another bottom view of the lighting device of FIG. 1; however, in FIG. 3, the reflective plate 135 is displaced (for the purposes of illustration) to show additional elements of the present invention. The displacement of the reflective plate shows a circuit board 160 mounted within the housing 105 and an inner grommet 155. The circuit board includes various electronic components 161 to which the LEDs 115 are connected via the LED wires 145. A power wire 165 delivers external electrical power to the components 161. The components 161 operate on the delivered power to convert the external power to be suitable for delivery to the LEDs 115. A ground wire 170 provides grounding to reduce the risk of electric shock.

Continuing to refer to FIGS. 1 through 6, the housing 105 has outer surface 109 on which heat sink fins 110 may be mounted. In the illustrated embodiment, the fins 110 are mounted proximal to each of the LEDs 115, each fin 110 preferably directly opposite each corresponding LED 115 at the inner surface 108 of the housing 105, so as to optimize heat transfer. The outer surface 109 is the opposite surface compared to the inner surface 108 of the housing 105.

To better explain the relative placement of the heat sinks 110 and the LEDs 115, from a geometric point of view, one may designate a central axis for housing 105, from which to base a cylindrical coordinate system to refer to the placement of each attached component. Preferably, each heat sink 110 and each LED 115 are placed at substantially the same angles around the conical part of the housing 105 and at the same height relative to housing 105, the only difference that the heat sinks are slightly more outward from the axis than the LEDs. Again, this configuration minimizes the distance between each LED 115 toward the inside of the housing and corresponding heat sink fin 110 toward the outside of the housing, thus optimizing the heat transfer from the housing inside to the outside. This relative positioning is better illustrated in FIG. 5.

FIG. 5 is another side view of the lighting device of FIG. 1 but with selected elements illustrated with dashed lines for even more clarity. FIG. 5 illustrates the heat sink fins 110 placed proximal to each of the LEDs 115. As an example, the LED 115*a*, mounted at the inner surface 108 of the housing 105 is proximal to its corresponding heat sink fin 110*a*, mounted at the outer surface 109 of the housing 105.

Also illustrated is the circuit board 160 placement inside the cylindrical section 106 of the housing 105. The power wire 165 extends beyond the lighting device 101.

FIG. 6 is a cutaway side view of a portion of the lighting device 101 illustrating the portion in more detail. In particular, FIG. 6 is a side cutaway view of a portion indicated as dash box 122 of the lighting device 101 (see FIGS. 4 and 6) illustrating the technique used to attach the transmissive plate 130 to the housing 105. The housing 105 and the retaining ring 120 define openings that are aligned. Fasteners 125 are threaded through the aligned openings. The fastener 125 engages a grommet 150, the grommet 150 having a D-shaped cross section, thereby securing the retaining ring 120 to the housing 105. The transmissive plate 130 is positioned between the housing 105 and the retaining ring 120. Because the retaining ring 120 has an L-shaped cross section, the retaining ring 120 is able to secure the transmissive plate 130 between itself and the housing 105.

Figure 7:
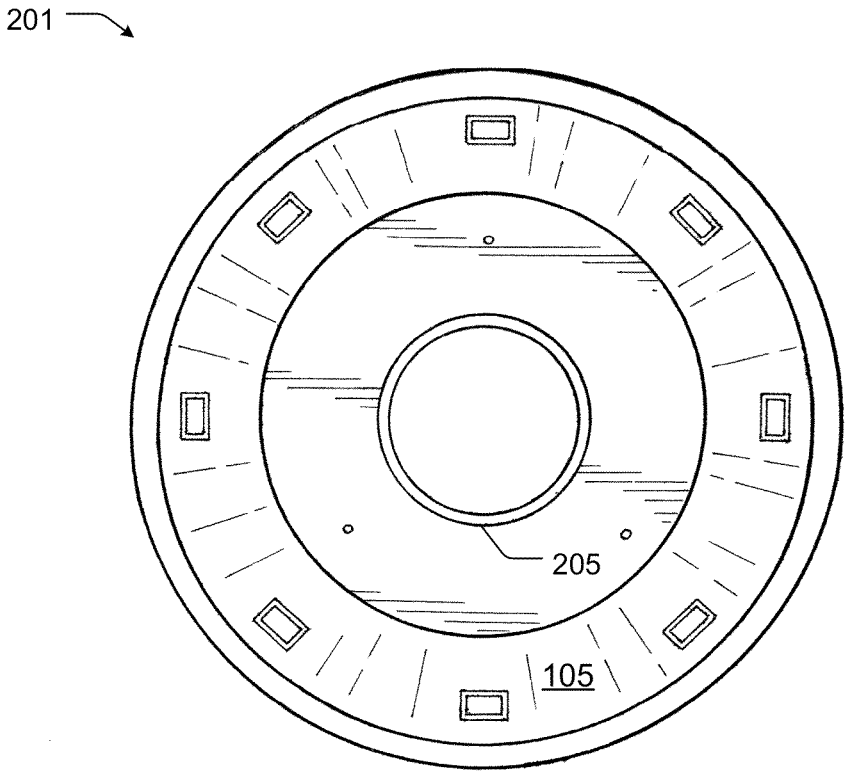
FIG. 7 is bottom view of an alternative modified lighting assembly.
Figure 8:
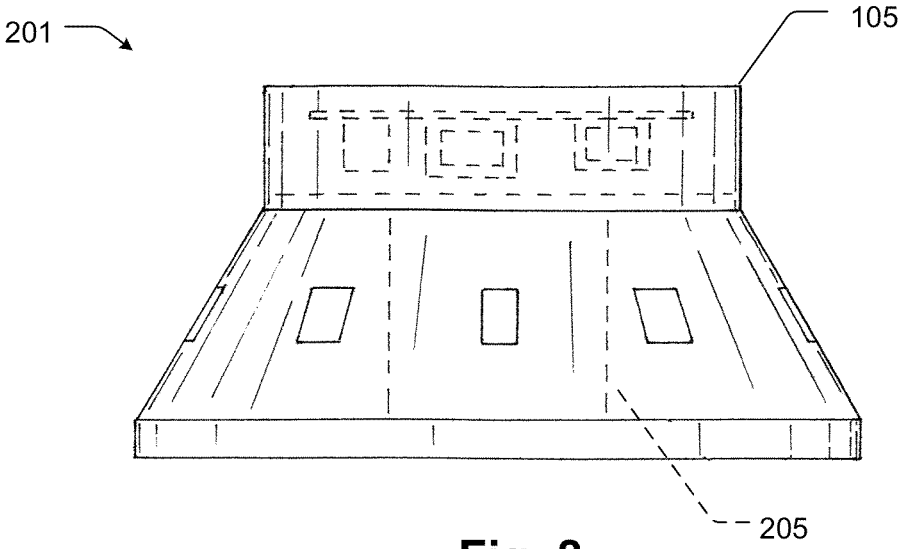
FIG. 8 shows a side elevation view of the modified lighting assembly of FIG. 7.

FIGS. 7 and 8 show an alternative embodiment of the lighting device 201. Referring to FIGS. 7 and 8, the lighting device 201 is configured substantially similar to the lighting device with some variances. The lighting device 201 features a reflective tube 205 disposed coaxially within the housing 105 running mostly at bottom center of the housing 105. The reflective tube 205 serves as a light redirector. The reflective tube 205 modifies angular spread of the light reaching from the LEDs away from the lighting device 201 toward the desired direction such as, for example, floor, product, and work areas, while blocking direct LED view from passerby and other personnel in the area. Direct light means light (or a beam of light) that is in the direct line of sight of the light producing device, in other words, non-reflected light. Though light redirector 205 is shown having a cylindrical shape, it may also be formed as a cone, hourglass, or bulb shaped structure as needed to adjust and modify the light output from the lighting unit.

It will be appreciated by one skilled in the art that the objects of the invention are achieved by the embodiments disclosed above. The lighting pattern effectively uses the light output from the substantially planar LEDs and redistributes it in a pattern that is helpful for use in a warehouse, walk-in cooler, or retail area. The construction of the lighting system is also flexible enough to be readily adapted for an assembly line.

Figure 9:
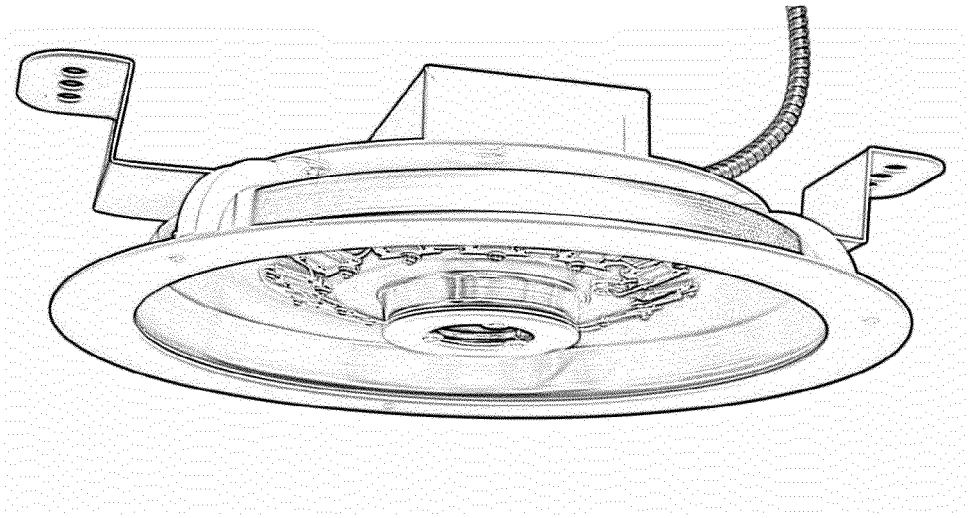
FIG. 9 shows a perspective view of another embodiment of the invention, featuring wings with holes for mounting to a ceiling or other structure.
Figure 10:
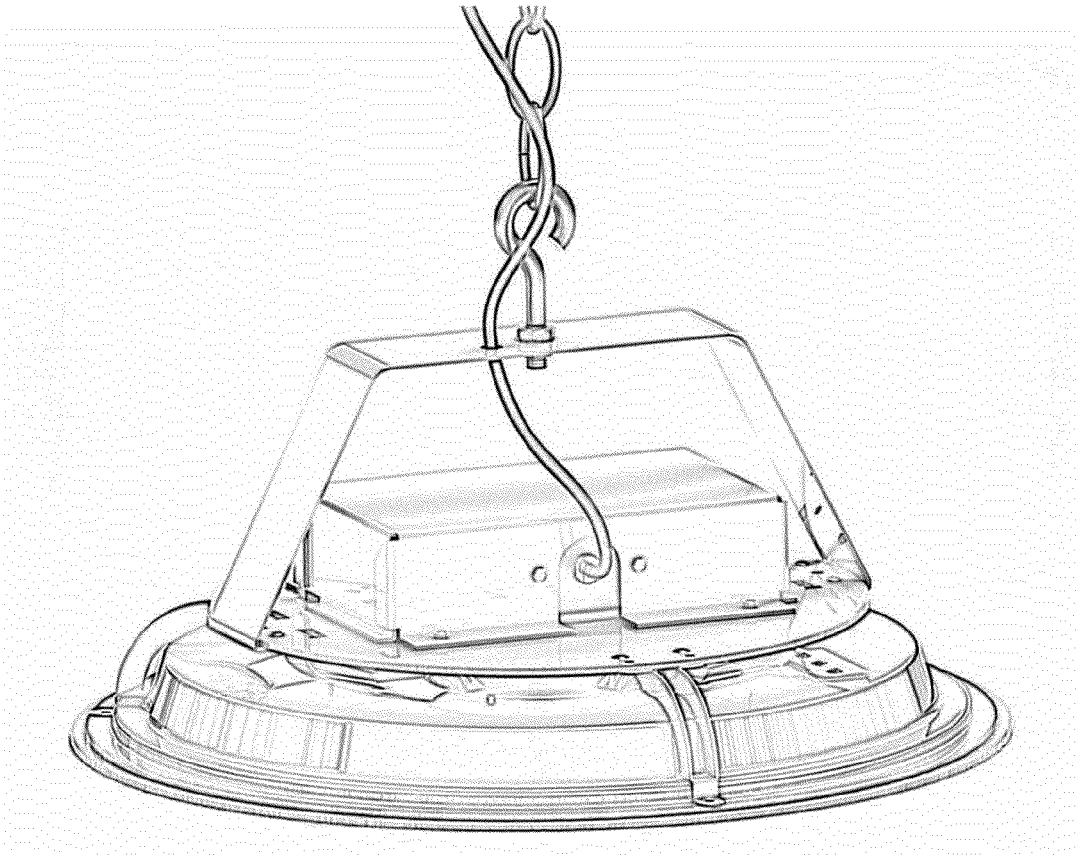
FIG. 10 shows a perspective view of yet another embodiment of the invention, featuring a bracket and hook for mounting to a suspended chain.
Figure 11:
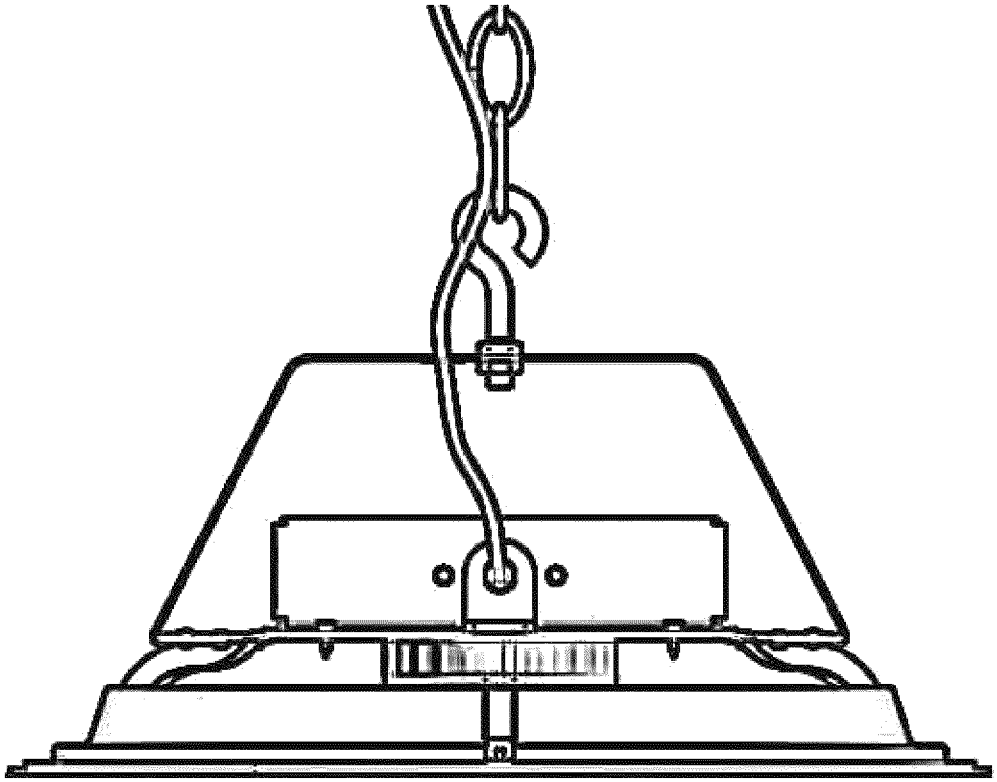
FIG. 11 shows a side view of the embodiment as in FIG. 10.
Figure 12:
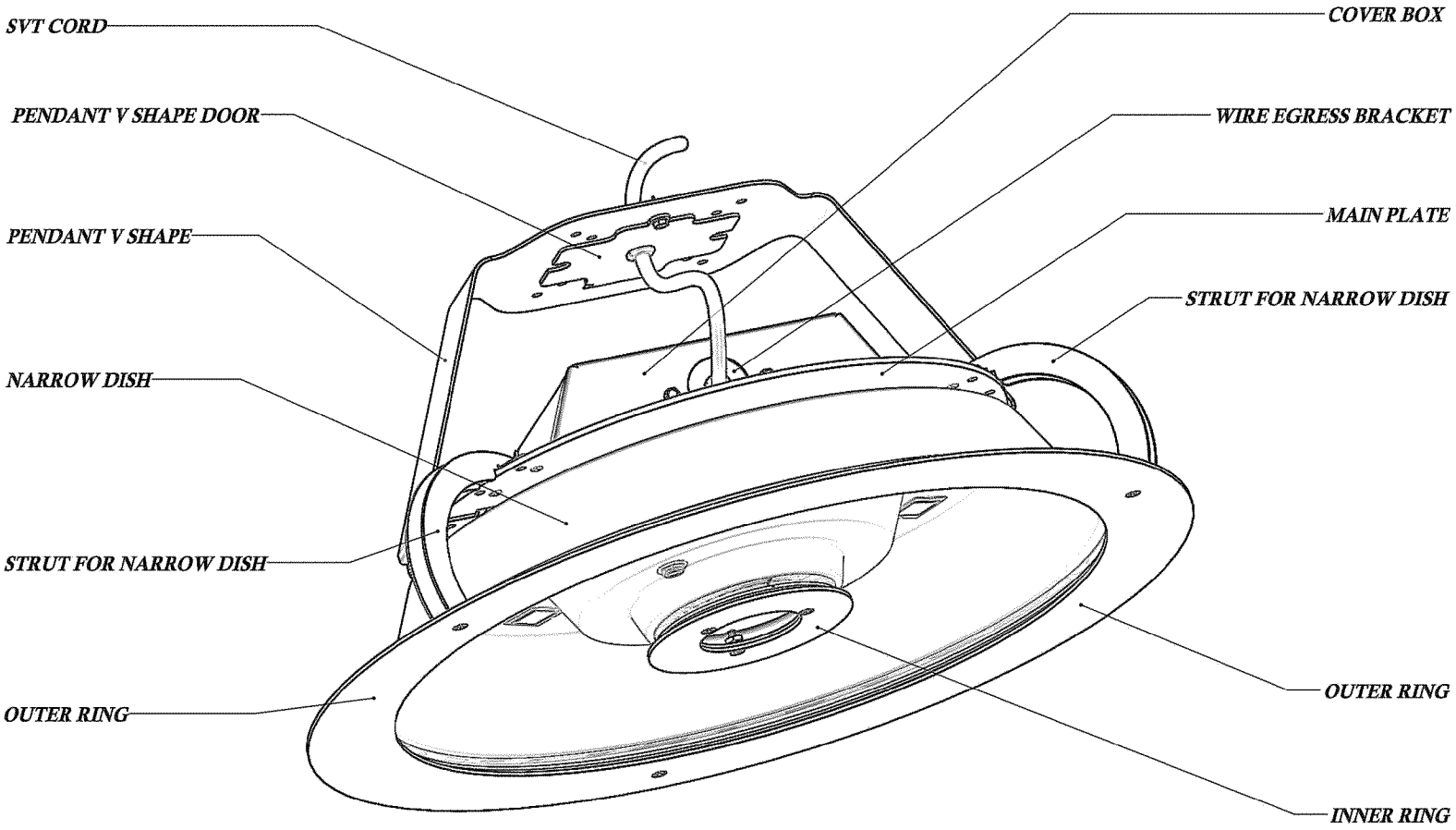
FIG. 12 shows a perspective view of yet another embodiment of the invention, featuring struts for securing a main plate to an outer ring.

Additionally, it is possible to modify the basic invention by adding mounting wings as in FIG. 9, or a bracket with hook as in FIGS. 10 and 11. It is further possible to reinforce the construction with struts as in FIG. 12.

Figure 13A:
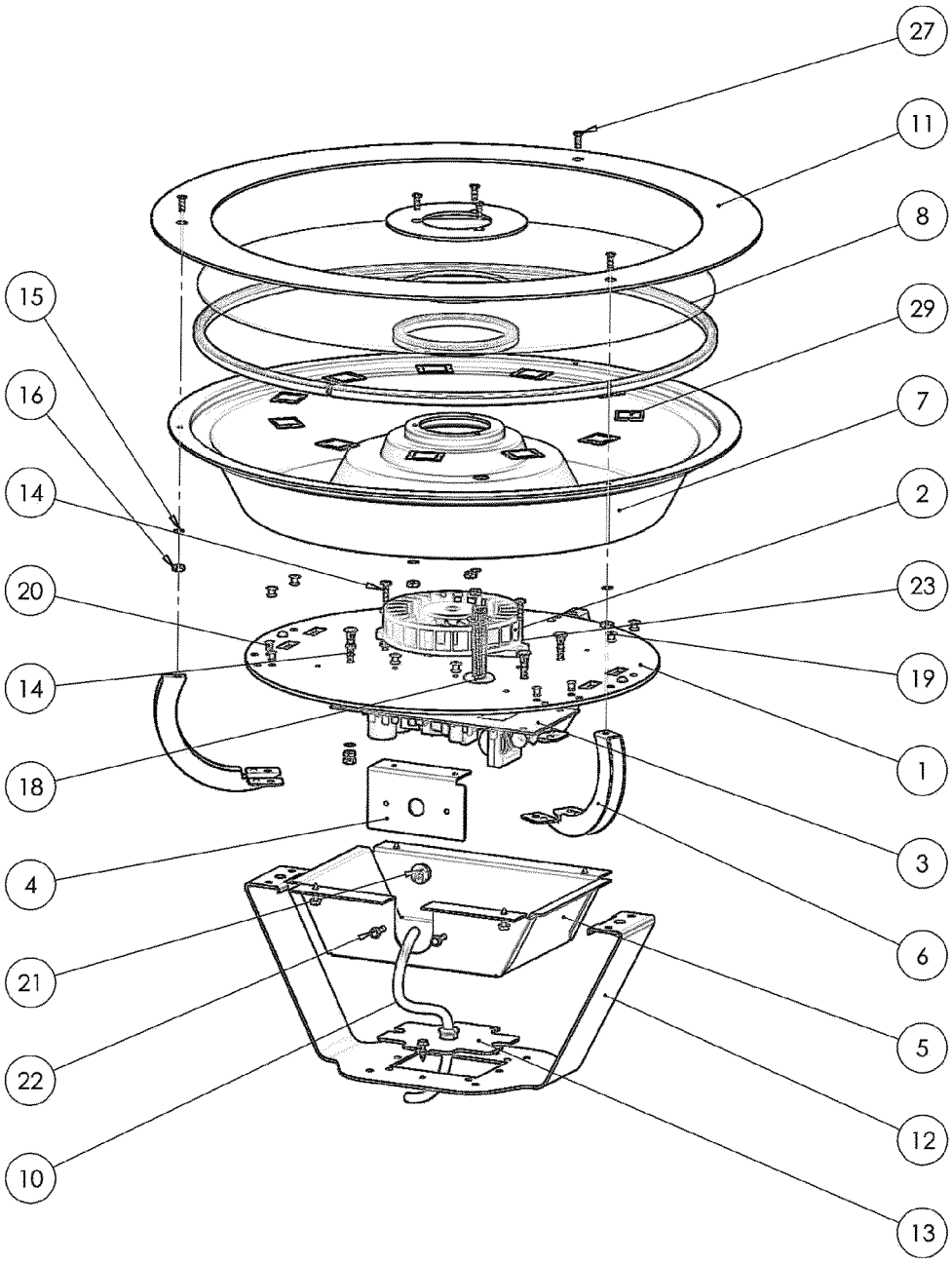
FIG. 13*a* shows a disassembled view of the embodiment in FIG. 12, with detail of a fan and power board.

Moreover, it is possible to add a cooling fan and electronics to control the fan. This is shown in FIG. 13*a*. The fan 2 may be ran from power conditioning supplied by circuit power board 3. The power board 3 may perform functions such as power factor correction and total harmonic distortion reduction, to be in compliance with utilities that favor or require a sinusoidal current draw in phase with the voltage. Power board 3 may also monitor the system temperature and modify the fan speed, whether by turning it on or off, or varying the speed, to control temperature. Power board 3 may also have remote control functions to allow turning on or off at various times of day or lighting conditions. Power board 3 may also be configured to perform a dimming function.

To conclude, with respect to the above description, it is to be understood that the optimal dimensional specifications for the parts of the invention, including variations in number, size, shape, form, placement, material and the method of fabrication and assembly, are deemed readily apparent to persons skilled in the art upon a reading of the foregoing description, and all equivalent specifications to those illustrated in the drawings and detailed in the description are intended to be encompassed by the present invention.

What is claimed is:

1. A lighting device comprising:

a housing having an inner surface and outer surface;

a plurality of LEDs mounted at the inner surface, the LEDs mounted in a radially symmetrical configuration;

a reflective tube disposed coaxially within the housing for redirecting light from the LEDs;

heat sinks mounted on the outer surface; and wherein each heat sink fin and each LED are placed at substantially the same angles around the housing and at the same height relative to the housing.

2. A lighting device comprising:

a housing including a cylindrical section and a conic section, the conic section having an inner surface and outer surface;

a plurality of LEDs mounted to the housing at the inner surface, the LEDs mounted in a radially symmetrical configuration;

a reflective tube disposed coaxially within the housing for redirecting light from the LEDs; and a plurality of heat sink fins mounted to the housing at the outer surface.

3. A method of producing light, the method comprising:

placing a plurality of LEDs around the interior of a housing having inner and outer sides;

placing a reflective tube coaxially within the housing for redirecting light from the LEDs; and placing a plurality of heat sink fins at substantially the same angles as the LEDs placed around the housing.

* * * * *